US005486056A

United States Patent [19]

Thorn

[11] Patent Number: 5,486,056

[45] Date of Patent: Jan. 23, 1996

[54] ADJUSTABLE, LOCKABLE DAMPER

[75] Inventor: Richard P. Thorn, Erie, Pa.

[73] Assignee: Lord Corporation, Erie, Pa.

[21] Appl. No.: 85,853

[22] Filed: Jun. 30, 1993

[51] Int. Cl.[6] ..... A47C 1/024

[52] U.S. Cl. ..... 403/322; 403/120; 403/84; 297/374; 297/354.12

[58] Field of Search ..... 188/17, 83, 72.7; 297/306, 354.12, 374, 375; 403/83, 84, 119, 120, 322

[56] References Cited

U.S. PATENT DOCUMENTS

| | | | |
|---|---|---|---|
| 1,716,468 | 6/1929 | Smith | 188/83 |
| 2,560,181 | 7/1951 | Morvice . | |
| 2,980,170 | 4/1961 | Bechtold . | |
| 3,195,952 | 7/1965 | Bache et al. . | |
| 3,275,109 | 9/1966 | Ganley | 188/83 |
| 3,309,138 | 3/1967 | Byczkowski et al. . | |
| 3,315,298 | 4/1967 | Strien et al. . | |
| 3,744,843 | 7/1973 | Barecki et al. . | |
| 3,747,888 | 7/1973 | Heckett . | |
| 3,758,092 | 9/1973 | McGregor . | |
| 4,062,587 | 12/1977 | Wolters . | |
| 4,219,234 | 8/1980 | Bell . | |
| 4,272,067 | 6/1981 | Yoshida et al. | 188/83 |
| 4,408,799 | 10/1983 | Bowman . | |
| 4,641,886 | 2/1987 | Dauphin | 297/375 |
| 4,708,392 | 11/1987 | Werner et al. . | |
| 4,824,172 | 4/1989 | Rees . | |
| 5,024,283 | 6/1991 | Deli | 403/120 |
| 5,117,959 | 6/1992 | Graton . | |
| 5,120,276 | 6/1992 | Maucher et al. . | |
| 5,257,680 | 11/1993 | Corcoran et al. | 188/129 |
| 5,328,242 | 7/1994 | Steffens et al. | 297/374 |

FOREIGN PATENT DOCUMENTS

| | | | |
|---|---|---|---|
| 1755192 | 7/1971 | Germany | 297/354.12 |
| 3513333 | 10/1986 | Germany | 297/375 |
| 1486649 | 6/1989 | U.S.S.R. | 188/83 |

*Primary Examiner*—Anthony Knight
*Attorney, Agent, or Firm*—Randall S. Wayland; Richard K. Thomson; James W. Wright

[57] ABSTRACT

An adjustable damper 12 for providing surface effect damping of a first member 10 when moving relative to a second member 20 and providing means for user operated locking of said first member 10 relative to said second member 20 at an infinite number of positions. The damper 12 is particularly useful for locking a chair back in place relative to a chair seat and providing damping of the rotation of the chair back when not locked. This allows the chair back to return to its desired position relative to the seat at a controlled rotational rate. The damper 12 operates by compressing first plate 40 and second plate 50 against elastomers 36A and 36B such that center plate 30 is restrained from rotation relative to plates 40 and 50. A secondary surface effect damping element provides damping when the primary damping element is unlocked. Pin 38 rides in slot 32 and indents the periphery 34 of elastomer 36C bonded to the periphery of slot 32 to provide damping. Slots 32 provide motion limitation between the first member 10 and the second member 20.

20 Claims, 3 Drawing Sheets

ADJUSTABLE, LOCKABLE DAMPER

FIELD OF THE INVENTION

This invention relates to the area of damper mechanisms. More specifically, the invention relates to the area of adjustable, elastomer-containing damper mechanisms for use on chairs and the like.

BACKGROUND OF THE INVENTION

With today's emphasis on ergonomics, products are being designed with the user's comfort in mind. Products such as chairs for the office are becoming more and more user friendly, in that they can be adjusted to a variety of positions to suit the individual needs or preferences of the user. Because of the ergonomic need for adjustability, many types of pivoting and damping mechanisms have been developed for use on chairs and other end assemblies.

One such device is described in U.S. Pat. No. 2,560,181 to Morvice in which a chair's reclining back 5 is mounted by brackets 9 and 10 which are pivotally connected by bolt 11. A torsion spring 18 resiliently connects brackets 9 and 10 to return the chair back to its original orientation. A friction disk 27 is pressed tightly against the bearing portion 23 of bracket 10 by a coiled compression spring 29. This friction force creates a restraining force to keep the seat back from springing back too quickly. However, there is no adjustment or locking available.

U.S. Pat. No. 3,195,952 to Bache et al. describes a seat with an infinitely adjustable inclining back wherein an arcuate slot 14 receives a bolt shaft within and the seat back 2 and the back pivots about the axis of a torsion bar 3. Holding pads 18 of friction elements act against sectors 13 of bracket and can be actuated by a lever 26 operated by the user to position the seat in any position. Although this device allows adjustment, these are complex components requiring multiple friction pads and are difficult to assemble; in addition, there is the possibility the friction pads will be improperly adjusted or will wear and the chair back will return to its upright position too abruptly.

U.S. Pat. No. 3,747,888 to Heckett describes an adjustable fluid pivot device. The device comprises an adjustable control wheel 20 for adjusting the level of compression of spring 26 by rotating tension block 16. Blades 34 rotate through a viscous fluid 36 to provide the rotational damping. However, this device lacks the capacity to lock.

U.S. Pat. No. 4,062,587 to Wolters describes a chair back positioning device comprising clutch plates 24 and 25 and wing plates 23 made of nylon and adjusted by lock and release handle 43. This device allows ease of adjustment, and some damping for providing controlled return of the seat back. However, this device is very complex, expensive, and difficult to assemble. Furthermore, the possibility of misadjustment and wear may, over time, cause the chair back to spring back too abruptly. Since seat adjustment is normally performed with the user seated in the chair, this abrupt return to full upright position may cause back injury.

U.S. Pat. No. 4,219,234 to Bell describes a chair back mechanism which utilizes dogs 80 and 82 that are actuated into engagement with arcuate slot 245 to lock seat back in position. However, this mechanism is too complex and also susceptible to wear.

SUMMARY OF THE INVENTION

In light of the advantages and shortcomings of the similar adjustable locking mechanisms and dampers, the present adjustable, lockable damper provides positive locking in an infinite number of positions, yet provides damping through a secondary means should the primary mechanism wear or be misadjusted, such that a controlled return of the moveable member will always be achieved, and thus, the moving member springs back slowly due to the damping means provided by the secondary mechanism. The present invention accomplishes both locking and controlled damping by an inexpensive, simple device.

In summary, the present invention provides an adjustable damping device for locking the relative positions of and damping motion between a first member relative to a second member, comprising at least two plates having inwardly and outwardly facing planar surfaces and first means for attaching each plate to one of said first and said second members; a center plate having two outwardly facing planar surfaces and second means for attaching to another of said first and said second members; at least two primary elastomer elements, one said element sandwiched between each of said inwardly facing planar surfaces of said plate and said outwardly facing planar surface of said central plate; user-operated means compressing said inwardly facing planar surfaces of said at least two plates against said at least two elastomer elements for selectively locking said first and second members to restrain relative movement and a secondary elastomeric element to damp said relative movement between said first and second members when said user-operated means is in an unlocked position.

The above mentioned and additional features, advantages and characteristics of the present invention will become apparent after a reading of the accompanying descriptions of the preferred embodiments taken in conjunction with the attached drawings.

BRIEF DESCRIPTION OF THE DRAWINGS

The accompanying drawings, which form a part of the specification, illustrate several embodiments of the present invention. The drawings and description together, serve to fully explain the invention. In the drawings.

DETAILED DESCRIPTION OF THE INVENTION

Figure 1:
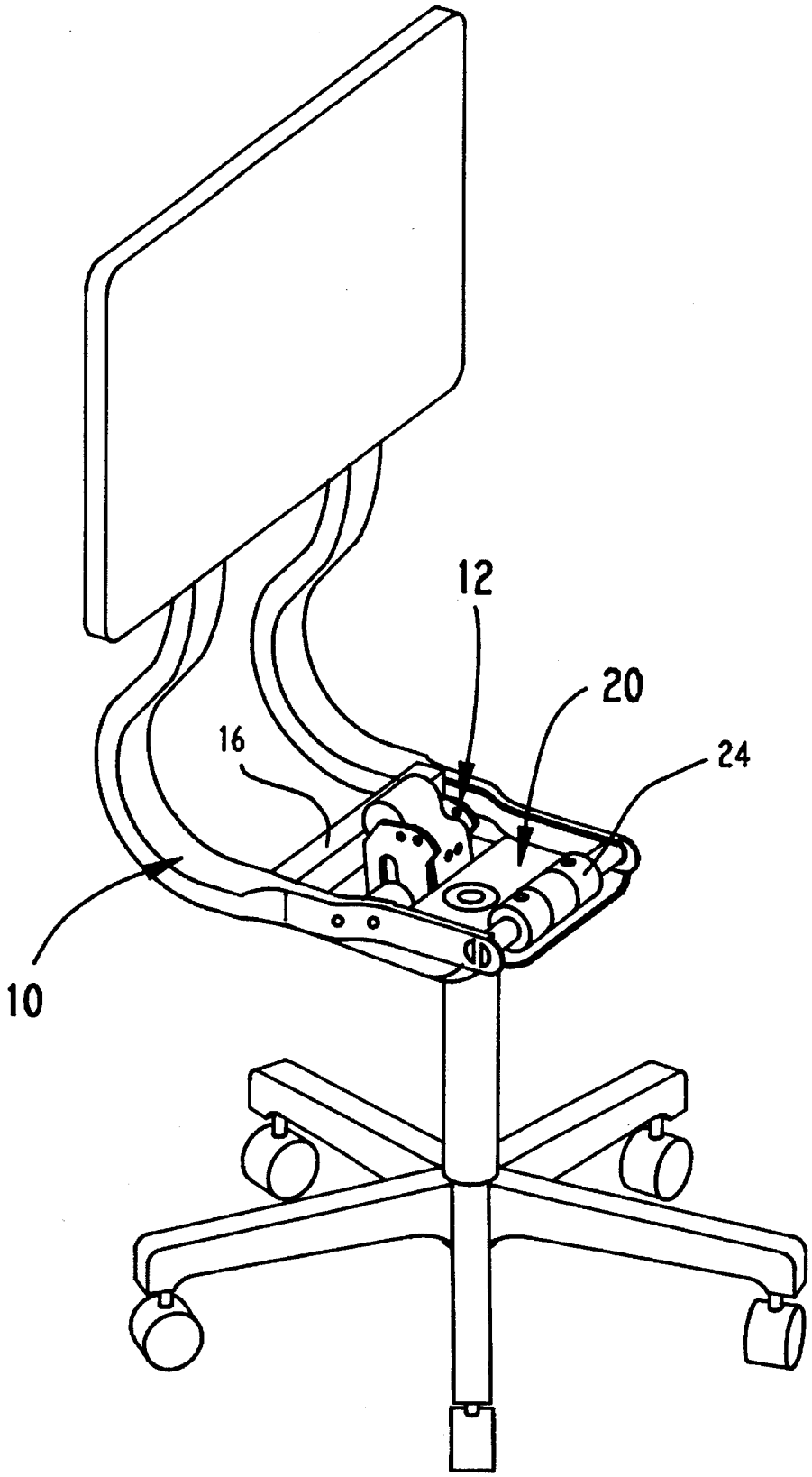
FIG. 1 is an isometric view of a chair assembly employing the adjustable damper of the present invention.

In FIG. 1, an embodiment of the adjustable clamper damper 12 is shown installed in the environment of an office chair. The clamper damper 12 attaches to a first member 10 such as a support for a seat back and also to a second member 20 such as a support for a chair seat so that relative movement between them can be damped. In addition, the members 10 and 20 can be locked together throughout a range of positions along an arc. As seen in greater detail in FIG. 1A, the clamper damper 12 is comprised of a center plate 30 which attaches to a first member 10, and more specifically to the crossbar 16 on the first member 10. The recess 39 in the center plate 30 is secured over crossbar 16 and is fastened in place by fasteners 18. A first plate 40 having an inwardly facing planar surface 44B (FIG. 2) and an opposed outwardly facing planar surface 44A is slidingly attached to the second member 20 by way of slider pins 60 pressed into a bracket 22 extending from second member 20. First and second elastomeric elements 36A and 36B, which are preferably thin elastomeric sheets, are bonded to outer surfaces 46A and 46B of center plate, respectively. The holes 42 in first plate 40 are free to slide laterally (into and out of the paper) on slider pins 60. A like second plate 50 (FIG. 2) is installed over slider pins 60 on the opposite side of center plate 30. This sliding action permits the plates 40 and 50 to float freely into and out of clamping engagement with elastomeric elements 36A and 36B for evenly distributed, optimum clamping.

Figure 2:
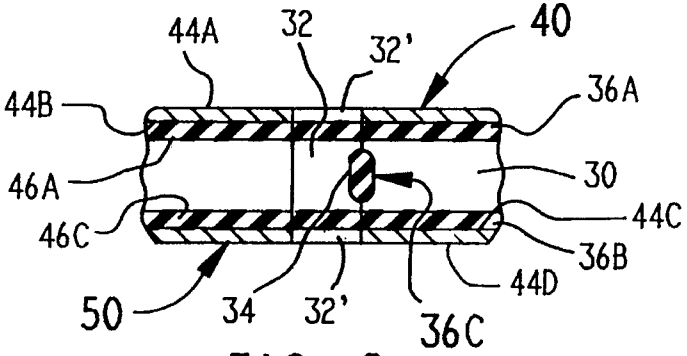
FIG. 2 is a cross sectioned view of the damper as seen along line 2—2 in FIG. 1A showing a first embodiment of pivot pin.

FIG. 2 shows a side sectioned view illustrating the damper 12 as seen along line 2—2 in FIG. 1 with first side plate 40, a second side plate 50, and first and second elastomeric elements 36A and 36B. First and second elastomeric elements 36A and 36B are bonded to the center plate 30 and made of a stiff, wear resistant material between 0.01–0.06 inches thick. Materials considered appropriate include highly damped natural rubber and various blends of synthetic and natural rubbers. The first elastomer element 36A is sandwiched between the inwardly facing planar surface 44B of the first plate 40 and the outwardly facing planar surface 46A of the center plate 30. The second elastomer element 36B is sandwiched between the inwardly facing planar surface 44C of the second plate 50 and the outwardly facing planar surface 46C of the center plate 30. Second plate 50 also has outwardly facing planar surface 44D. The elastomer elements 36A and 36B are bonded to the center plate 30 by conventional techniques, which could include hot and/or cold bonding.

Clamping surfaces 44B and 44C are best made from smooth materials that are compatible with the elastomer and have a high coefficient of friction such as aluminum, steel and some reinforced plastics. These surfaces must lock firmly with elastomer elements 36A and 36B when clamped but must release fully and slide freely when released. Center plate 30 is typically made from a reinforced bearing material such as a glass reinforced nylon, or may be a metal element with bearing inserts.

A pin 38 slides within an arcuate slot 32 which is formed in the center plate 30 and in corresponding slots 32' in first and second plates 40 and 50. The pin 38 rides on the periphery 34 of a secondary elastomer element 36C which causes damping and allows the first member 10 to move at a controlled rate relative to the second member 20. The secondary elastomer element 36C is bonded to the center plate 30 and is preferably comprises a layer of highly-damped rubber between 0.06–0.2 inches thick which is received in a groove formed in slot 32. Pin 38, acting as a rubee or single lobe indenter, deforms the secondary elastomer element 36C. The ends of slots 32, 32' also provide motion limitation between the first and second member 10 and 20. In this application, the first member 10 pivots about a pivot axis A. A bolt or other fastener (not shown) pivotally attaches the bore 15 of first member 10 to a lug 24 on second member 20. The damping force that is achieved is a function of the elastomeric material and material of pin 38 and the level of precompression of elastomeric element 36C.

Figure 3:
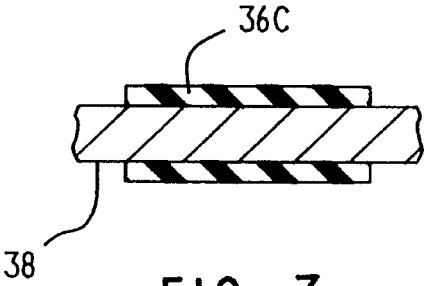
FIG. 3 is a side sectional view of a second embodiment of pivot pin.

FIG. 3 shows another embodiment of pin 38 where the secondary elastomer element 36C is bonded to the pin 38 along its length instead of inside the slot 32 of the center plate 30. This may be desirable in some applications; however, the first embodiment is preferred due to its superior wearability and consistent long term damping performance.

Figures 4, 5, 6, 7, 8:
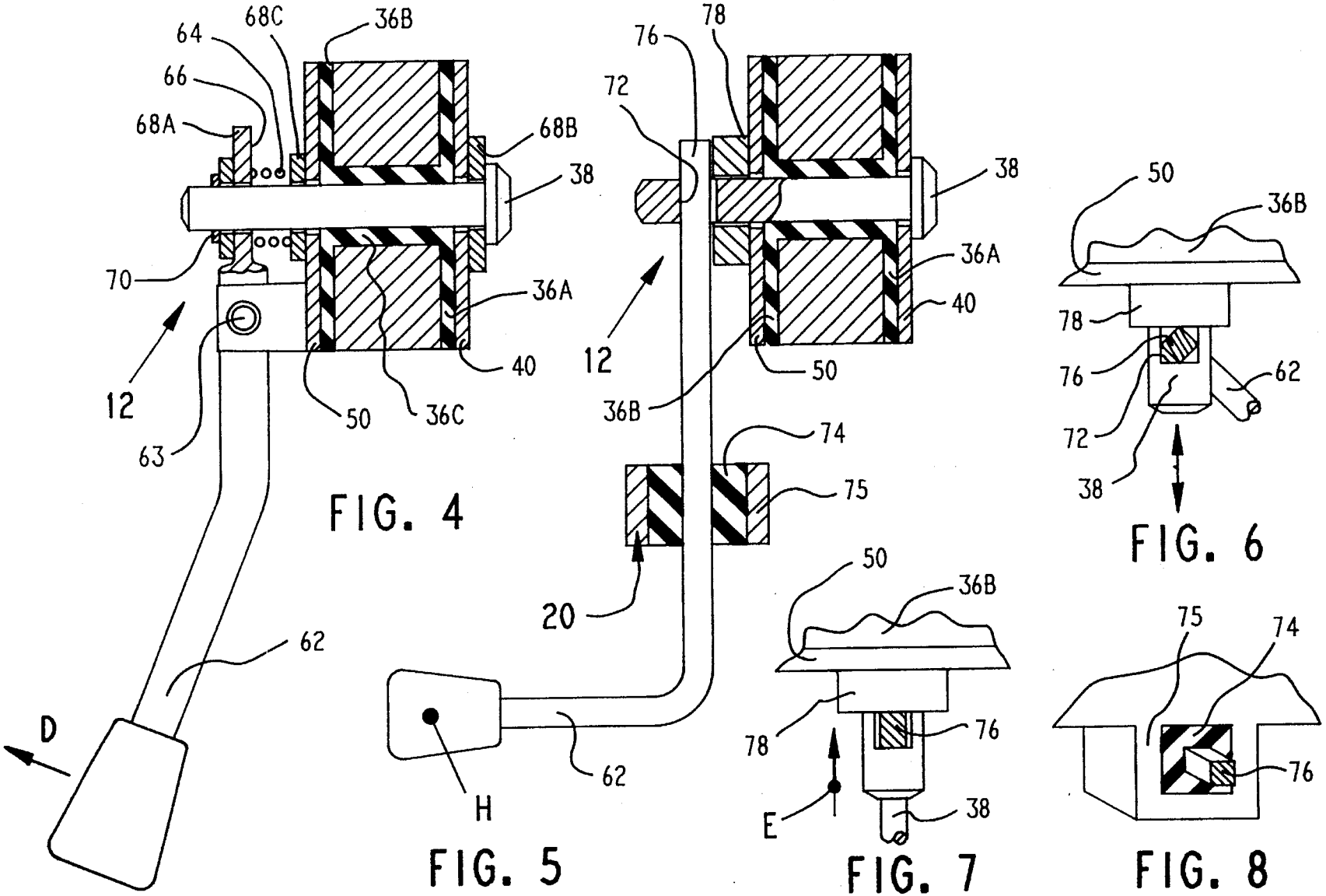
FIG. 4 is a partial cross sectional view of a first embodiment of a means for compressing and selectively locking and unlocking the damper.
FIG. 5 is a partial cross sectional view of another embodiment of means for compressing and selectively locking and unlocking the damper.
FIG. 6 is a side view of a means for compressing and selectively locking and unlocking the damper shown in the locked position.
FIG. 7 is a side view of a means for compressing and selectively locking and unlocking the damper shown in the unlocked position.
FIG. 8 is an isometric view of the rubber bushing as installed in the frame.

FIG. 4 shows an embodiment of the damper 12 illustrating one means for compressing the first plate 40 against the first elastomer element 36A and for compressing the second plate 50 against the second elastomer element 36B to accomplish locking and damping. While FIGS. 4–8 illustrate two embodiments of actuators for clamping plates 40, 50, it will be understood that various other devices could be utilized to accomplish this releasable clamping function. Normally, when the user is not exerting a force outwardly along vector D on the lever 62, the spring 64 exerts a force against the washer 68C which presses against second plate 50. The spring 64 also exerts a force against the underside 66 of lever 62. This, in turn, exerts a force on washer 68A and through C-Clip 70 and into pin 38. This force is exerted on washer 68B and finally transferred into first plate 40 such that the first and second plates, 40 and 50, exert a force clamping elastomer elements 36A and 36B. This clamping restricts the motion of the first member 10 relative to the second member 20 to a desired range of motions selected by the particular user.

Figure 1A:
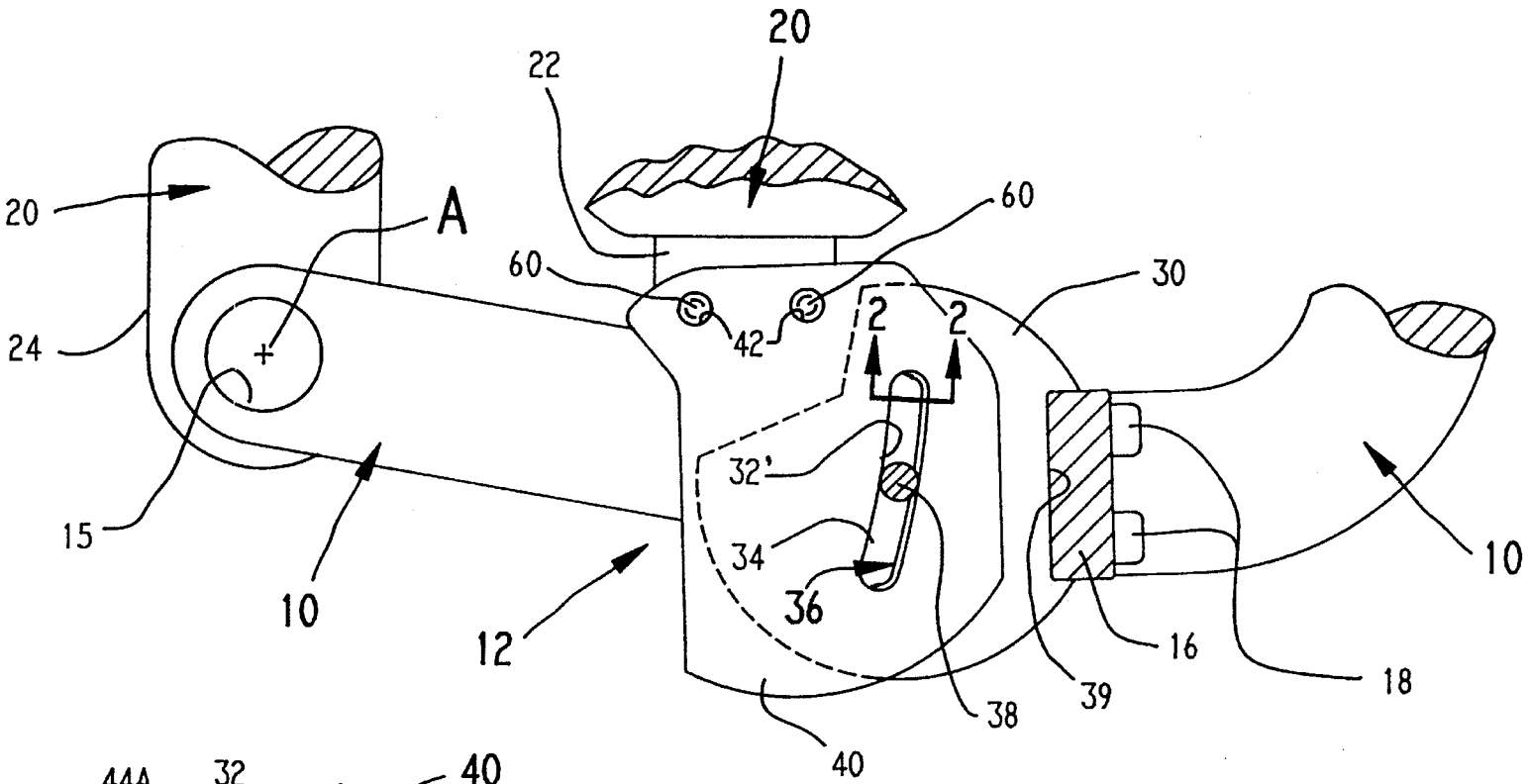
FIG. 1A is a side view of the adjustable damper assembled in a chair with the details of the means for compressing the damper omitted for clarity.

When the user exerts a force on the lever 62 in the direction of the vector D, lever 62 pivots about pin 63 compressing spring 64, thereby reducing the force on the first and second plates 40 and 50 and the first and second members 10 and 20 (FIG. 1) are free to move relative to each other. However, primary damping is partially maintained because there is still some engagements between first and second plates 40 and 50 and elastomeric members 36A and 36B but more significantly, secondary elastomer element 36C acts against pin 38 to create a secondary damping force. This secondary damping can be important to maintain damping of the system when elastomer elements 36A and 36B wear or the locking mechanism is otherwise misadjusted. This provides a controlled return rate of the seat back ,i.e., the first member 10 takes between 0.25–2 sec to rotate through an arc of approximately 10 degrees. Turning attention back to FIG. 1A, in order to obtain the surface effect damping level desired, there is an interference fit between the free width of the periphery 34 of secondary elastomer element 36C with the diameter of the pin 38. For a description of surface effect damping, see commonly assigned copending application Ser. No. 07/812,192 filed Dec. 20, 1991, now U.S. Pat. No. 5,257,680 hereby incorporated by reference.

FIG. 5 illustrates another means for locking and unlocking the clamper damper 12. The device for pressing the plates 40 and 50 towards each other and thus compressing elastomer elements 36A and 36B is comprised of a pin 38 with a square-shaped slot 72 formed therein. A square-cross-section shaft 76 of lever 62 is inserted through bushing 74 which is pressed in frame 75 attached or integral to second member 20 (FIG. 1). By actuating lever 62 into and out of the paper at H, the damper 12 is locked and unlocked by exerting opposing forces on thrust bushing 78 and slot 72 in pin 38.

FIG. 6 illustrates the locked configuration of this second means for compressing the damper. The lever 62 is rotated by the user by pressing at H (FIG. 5). This rotates the shaft 76 within the slot 72 and axially (along arrow) actuates pin 38 relative to thrust bushing 78. The square shaft 76 acts like a cam and the slot 72 like a cam follower. This cam-like action can be accomplished by any cam shape, including square, offset round, or any other type of lobe element. This compresses elastomer elements 36A and 36B (FIG. 5). The orientation of the lever 62 is shown in FIGS. 5 and 6, with bushing 74 having been omitted, for clarity.

FIG. 7 shows the same device in the unlocked position. Because the distance across the flats of the square section of shaft 76 is less than the distance across the comers of the cross section of the shaft 76, the rotation of the lever 62 will allow the pin 38 to move in the direction of the arrow E, thus relieving compression of elastomer element 36A and 36B (FIG. 5) and allowing members 10 and 20 to move relative to one another.

FIG. 8 illustrates the positioning of the shaft 76 relative to the bushing 74 in the unlocked position. The bushing is inserted into the frame 75 and can be glued or bonded directly to the shaft 76 and/or frame 75. The bushing 74 is made from natural rubber, or the like.

While several embodiments of the present invention have been described in detail, various modifications, alterations, changes and adaptations to the aforementioned may be made without departing from the spirit and scope of the present invention defined in the appended claims. For example, it is not necessary to have two plates 40 and 50 with two elastomer elements 36A and 36B, only one plate and element may be used and accomplish similar results, although more consistency is obtained thorough equal application of opposed forces using the two-plate configuration. Furthermore, the damper can be used in a linear-acting, as opposed to a rotational, system. It is intended that all such modifications, alterations and changes as fall within the scope of the appended claims be considered part of the present invention.

What is claimed is:

1. An adjustable, lockable damping device for damping motion between a first member relative to a second member, comprising:

(a) a first relatively thin flat plate having inwardly and outwardly facing planar surfaces and attachment means for attaching to one of said first and said second members;

(b) a second relatively thin flat plate having inwardly and outwardly facing planar surfaces and attachment means for attaching to one of said first and said second members, said second plate being attached to the same one of said first and said second members as said first plate;

(c) a center plate having two opposed outwardly facing planar surfaces and attachment means for attaching to a remaining one of said first and said second members;

(d) a first elastomer element sandwiched between the inwardly facing planar surface of said first plate and an outwardly facing planar surface of said center plate;

(e) a second elastomer element sandwiched between the inwardly facing planar surface of the second plate and another outwardly facing planar surface of said center plate;

(f) user-operable clamping means compressing said outwardly facing planar surfaces of said first and said second plates against said elastomer elements with a first compression force in a first non-user-engaged position, lever means for moving said user-operable clamping means to a second position substantially reducing said first compression force, such that said first and second members can be selectively locked relative to said center plate to restrain relative movement between said first and said second members; and (g) surface effect damper means provided for maintaining damping between said first and said second members even when said clamping means is in said second position, such that rotational motion of said first member is damped relative to said second member whereby said first and said second members move relative to each other at a controlled rate.

2. The damping device in accordance with claim 1 wherein said user-operable clamping means compressing said outwardly facing planar surfaces of said first and second plates against said elastomer elements is spring loaded and lever actuated.

3. The damping device in accordance with claim 1 wherein said user-operable clamping means compressing said outwardly facing planar surfaces of said first and second plates against said elastomer elements includes a cam element formed on a shaft that is rotated within a slot formed in a pin.

4. The damping device in accordance with claim 1 wherein said surface effect damper means is a pin which acts against an elastomer bonded into a slot formed in said center plate.

5. The damping device in accordance with claim 1 wherein said surface effect damper means is a pin with a layer of elastomer bonded thereto which acts against a slot formed in said center plate.

6. The damping device in accordance with claim 1 wherein said first member pivots relative to said second member.

7. An adjustable, lockable clamping and damping device for damping rotary motion between a first member relative to a second member, comprising:

(a) at least two relatively thin flat plates each having inwardly and outwardly facing planar surfaces and means for attaching said at least two plates to one of said first and said second members;

(b) a center plate having two outwardly facing planar surfaces and means for attaching to a remaining one of said first and second members;

(c) at least two elastomer elements, one of said elements being sandwiched between said inwardly facing planar surface of each said plate and each said outwardly facing planar surface of said center plate; and (d) user-operable clamping means which, in a first position, compresses said two inwardly facing planar surfaces of said at least two relatively thin flat plates against said at least two elastomer elements with a compressive force and, in a second user-operable position, reduces said compressive force, said user-operable clamping means providing said first and second members the capacity to be selectively locked in a variety of positions to restrain relative movement.

8. The clamping and damping device in accordance with claim 7 wherein said first member pivots relative to said second member.

9. The clamping and damping device in accordance with claim 7 wherein said at least one plate is slidably mounted on at least two pins to allow even compression of said at least one elastomer element.

10. The clamping and damping device in accordance with claim 7 wherein said at least one elastomer element is between 0.01 and 0.06 inches thick and is made of a material selected from the group consisting of highly damped natural rubber and blends of synthetic rubber and natural rubber.

11. The clamping and damping device in accordance with claim 7 further including a secondary damping element.

12. The clamping and damping device in accordance with claim 11 wherein said secondary damping element comprises a surface effect damping element which provides a defined minimal level of resistance to relative rotational motion between said first and second members.

13. An adjustable, lockable damping device for damping motion between a first member which is pivotable relative to a second member about a pivot axis, said device comprising:

(a) at least two relatively thin flat plates spaced apart from said pivot axis and each having inwardly and outwardly facing planar surfaces and means for attaching to said second member;

(b) a center plate spaced apart from said pivot axis and having a pair of outwardly facing planar surfaces and means for attaching to said first member;

(c) at least two elastomer elements spaced apart from said pivot axis, one each of said elastomer elements sandwiched between the inwardly facing planar surface of one of said at least two relatively thin flat plates and one of said outwardly facing planar surfaces of said center plate; and (d) selectively operable means, in a first position, compressing said inwardly facing planar surfaces of said at least two plates against each respective said elastomer element with a first compressive force, and a second user-selectable position in which said compressive force is substantially reduced, such that said first and second members can be selectively locked to restrain relative rotational movement of said first and said second members about said pivot axis.

14. The damping device in accordance with claim 13 further including a surface effect damper for maintaining damping between said first and second members even when in an unlocked condition such that said first member moves relative to said second member at a controlled rate.

15. The damping device in accordance with claim 13 further including a lever operated mechanism for releasing said first compressive force.

16. The damping device in accordance with claim 15 wherein said lever operated mechanism for releasing said first compressive force has a cam formed thereon for interacting with a cam follower.

17. The damping device in accordance with claim 13 wherein said at least two elastomer elements are made of natural rubber.

18. The damping device in accordance with claim 17 wherein said at least two elastomer elements are bonded to opposite sides of said center plate.

19. The damping device in accordance with claim 18 further comprising a secondary elastomer for lightly damping relative rotational movement between said first and second members wherein said secondary elastomer is between 0.06 and 0.2 inches thick.

20. The damping device in accordance with claim 19 wherein said secondary elastomer comprises a layer of highly damped elastomer bonded in a groove formed in a slot in said center plate.

* * * * *